United States Patent [19]

Monyak et al.

[11] 3,980,202

[45] Sept. 14, 1976

[54] GARBAGE CAN COVER RETAINER

[76] Inventors: Arnold Monyak; George Spector, both of 3615 Woolworth Bldg., 233 Broadway, New York, N.Y. 10007

[22] Filed: Dec. 2, 1975

[21] Appl. No.: 636,927

[52] U.S. Cl. ..... 220/318; 220/1 T; 292/288

[51] Int. Cl.[2] ..... B65D 45/00; E05C 19/18

[58] Field of Search ..... 220/318, 324, 326, 1 T; 292/288, 254, 258, 259

[56] References Cited

UNITED STATES PATENTS

| | | | |
|---|---|---|---|
| 2,998,276 | 8/1961 | Shettler | 292/288 |
| 3,124,381 | 3/1964 | Geldart | 292/288 X |
| 3,363,924 | 1/1968 | Remig | 220/318 X |
| 3,503,535 | 3/1970 | Sparks, Sr. | 292/288 X |

*Primary Examiner*—William Price
*Assistant Examiner*—Steven M. Pollard

[57] ABSTRACT

A device for securing a lid or cover upon an out-of-doors garbage can, so to prevent a wind from blowing the cover away or refuse collection men from leaving the covers scattered about, instead of replacing them upon the can, after a refuse collection; the device in a preferred design of the invention consisting of a heavy nylon strap secured at one end to the cover handle and which at its other end is secured to a handle on a side of the garbage can.

2 Claims, 3 Drawing Figures

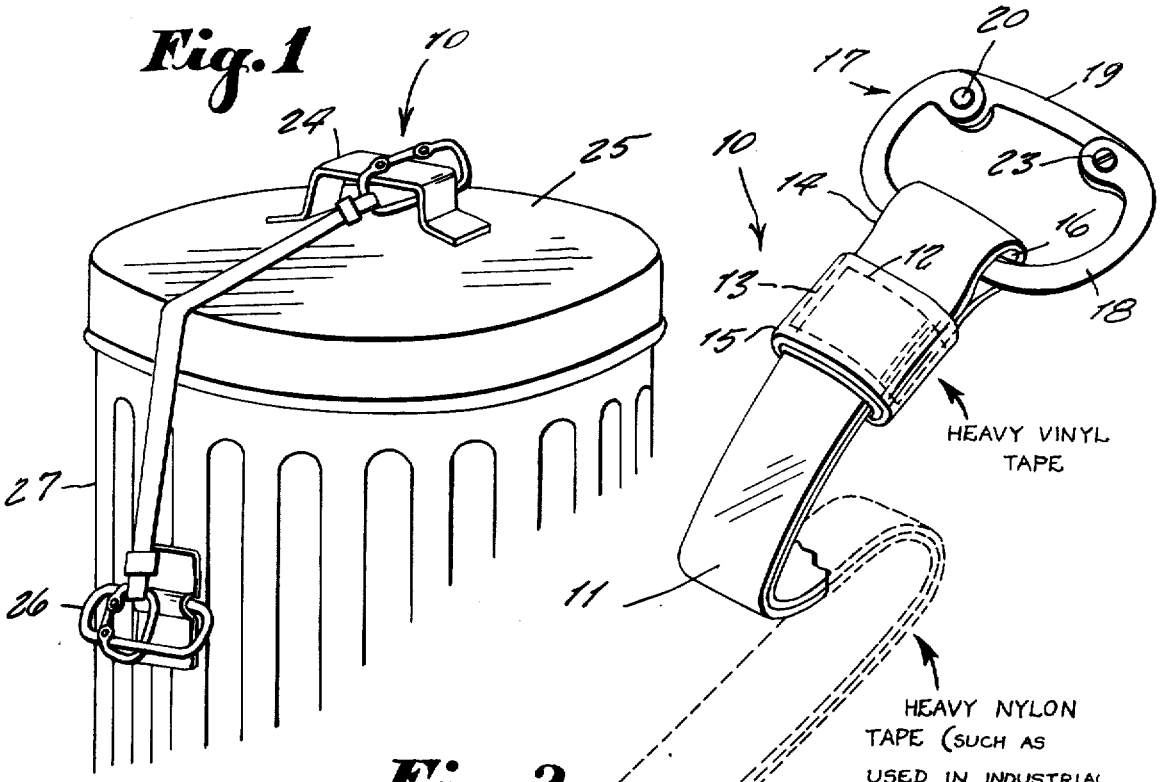
Fig. 1
10
24
25
27
26
20
17
19
10
14
23
16
12
13
18
15
HEAVY VINYL TAPE
11
HEAVY NYLON TAPE (SUCH AS USED IN INDUSTRIAL PACKAGING)
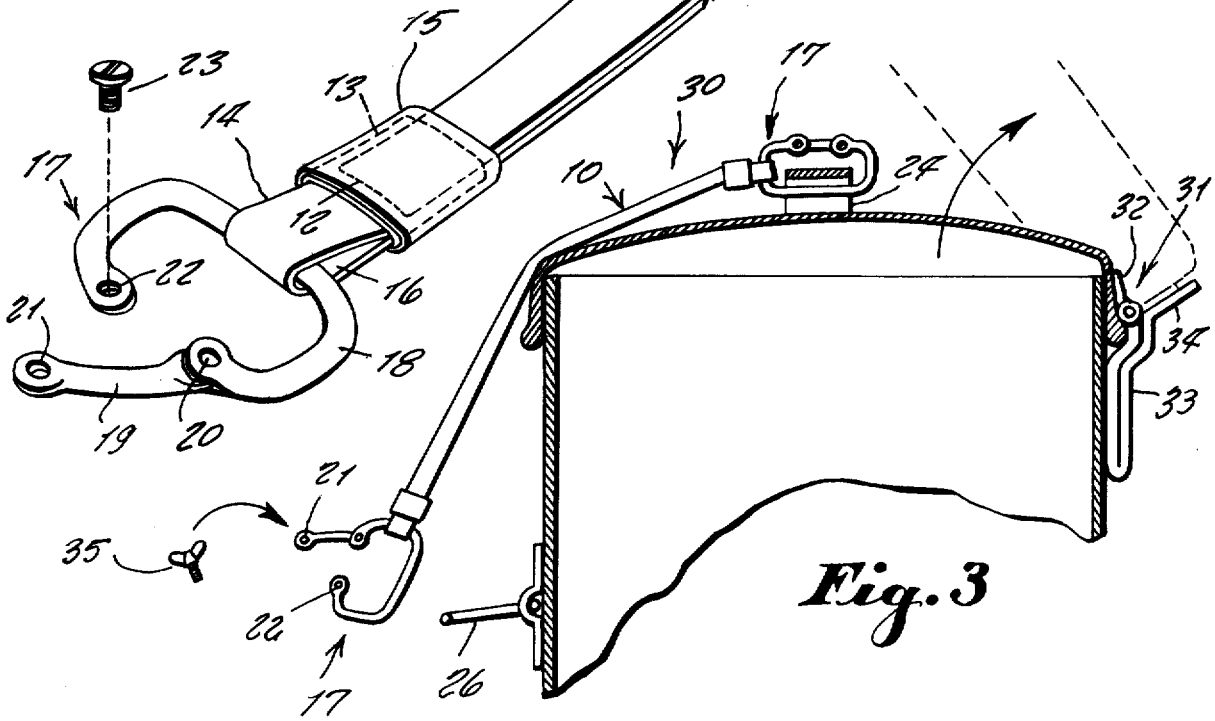
Fig. 2
23
15
13
14
17
12
22
16
21
18
19
20
21
35
22
17
30
17
10
24
32
31
34
33
26
Fig. 3

GARBAGE CAN COVER RETAINER

This invention relates generally to refuse containers such as are placed out-of-doors for being emptied by refuse collection men.

It is well known that refuse collection men after emptying a refuse can are often careless about replacing the cover upon the can, so that a resident is subject to being fined if a sanitation inspector discovers the same. This situation is, of course, objectionable and is, therefore, in want of an improvement.

Accordingly, it is a principal object of the present invention to provide a fastener whereby a cover is attached to a garbage or refuse can so that they are not lost from each other such as in a high wind or by careless refuse collection men, and thus being readily available for proper placement together.

Another object is to provide a fastener which in one design of the invention locks the cover on the can so to prevent stray animals, foraging for food, from lifting the cover off the can and scattering garbage about a premises.

Still further object is to provide a fastener with a cover that is hinged in a manner upon a can so that it automatically closes the can whenever the can is upright, thus eliminating any extra attention for placing the cover on the can.

Other objects are to provide a fastener which is simple in design, inexpensive to manufacture, rugged in construction, easy to use and efficient in operation.

These and other objects will be readily evident upon a study of the following specification and the accompanying drawing wherein:

FIG. 1 is a perspective view of the invention in use on a garbage can.

FIG. 2 is an enlarged view of the invention shown per se.

FIG. 3 is a side view of a modified design of the invention in which the invention is permanently secured at one end to a garbage can lid, and the other end of the invention is detachably attachable to the can handle; the lid being hingedly attached to the can, so that in this design, the lid cannot be separated and lost from the can, while still allowing a refuse collector to dump the can by allowing him to detach the invention from the can handle, and when the invention is attached to the handle, no dogs or other animals can open the lid for scattering the garbage.

Referring now to the drawing in greater detail, and more particularly to FIGS. 1 and 2 thereof at this time, the reference numeral 10 represents a fastener or garbage can cover retainer according to the present invention wherein the same comprises an elongated strap 11 made of several thicknesses of heavy nylon tape, such as is used in industrial packaging, each opposite end 12 of the strap 11 being attached to opposite ends 13 of a folded over loop strap 14 by means of a heavy vinyl tape 15 that is wound up around the enjoined ends 12 and 13. Thus the longitudinal center of the loop strap forms a loop 16. A forged metal ring 17 is attached to each loop 16; each ring 17 consisting of a C-shaped member 18 having a bar 19 pivotally secured to one end thereof by means of a rivet or pivot pin 20.

The opposite end of the bar has an opening 21 while the opposite end of the C-shaped member has a threaded opening 22 for both receiving a screw 23 so to lock the ring on the loop.

One of the rings 17 is also hooked around a handle 24 of a garbage can cover 25 while the other ring 17 is also hooked around a handle 26 on a side of a garbage can 27. The strap device 10 can be also attached to a handle on an opposite side of the can 27, if so wished.

It is evident that the device can thus be quickly and easily installed on the can and cover by simply removal of the screw 23 on each ring.

In FIG. 3, a modified design of the invention 30 includes the above described fastener 10 and the can 27 together with cover 25. However, in this design of the invention, the cover is pivotally secured to the can by a hinge 31 that includes a hinge plate 32 secured to the cover and a hinge plate 33 secured to the can; the hinge plate 33 including a lug 34 extending angularly and outwardly so to serve as a stop against which the cover abuts when it is pivoted upwardly, thus limiting the pivotal travel of the cover so that whenever a grasp of the cover handle is released, the cover automatically falls down so to close the can. Thus, there is an uncovered can. In this design, the hinge is on an opposite side of the can to the can handle 26, so that the ring must be manually unlocked from handle 26 in order to lift the cover. This is accomplished by use of a wingscrew 35 instead of the screw 23, so the ring can be opened without need of any tool such as a screw driver.

Thus different designs of the invention are provided.

While various changes may be made in the detail construction, it is understood that such changes will be within the spirit and scope of the present invention as is defined by the appended claims.

What is claimed is:

1. In a garbage can cover retainer, the combination of a garbage can, a removable cover placed upon an open upper end of said can, and a fastener attached at one end to a handle upon said cover and attached at its other end to one handle on a side of said can, said fastener comprising an elongated strap of several thickness of heavy nylon tape, opposite end of said tape each being secured by a heavy vinyl tape to a loop strap retaining a metal ring consisting of a C-shaped member pivotally attached to a bar for closing said ring, and a removable screw securing said ring in a closed position.

2. The combination as set forth in claim 1 wherein said removable screw comprises a thumb screw, and said cover is pivotally attached to said can by a hinge having a stop for limiting the pivotal travel upwardly of said cover so that when released, said cover automatically falls to close said can open upper end.

* * * * *